US005163280A

United States Patent [19]

Grau

[11] Patent Number: 5,163,280

[45] Date of Patent: Nov. 17, 1992

[54] APPARATUS FOR SYNCHRONOUSLY DRIVING PLURAL SPINNING ELEMENTS IN A TEXTILE SPINNING MACHINE

[75] Inventor: Gerhard Grau, Muellheim, Fed. Rep. of Germany

[73] Assignee: Zinser Textilmaschinen GmbH, Ebersbach/Fils, Fed. Rep. of Germany

[21] Appl. No.: 649,581

[22] Filed: Feb. 1, 1991

[30] Foreign Application Priority Data

Feb. 14, 1990 [DE] Fed. Rep. of Germany ..... 4004524

[51] Int. Cl.[5] ..... D01H 13/00

[52] U.S. Cl. ..... 57/100; 57/104

[58] Field of Search ..... 57/67, 71, 100, 104, 57/105, 267, 276, 277; 474/84, 85, 86, 87, 88, 148

[56] References Cited

U.S. PATENT DOCUMENTS

| | | | |
|---|---|---|---|
| 1,912,072 | 5/1933 | Fraser et al. | 57/267 |
| 1,973,348 | 9/1934 | Kooistra | 474/86 X |
| 2,428,142 | 9/1947 | Carter | 474/88 X |
| 3,022,624 | 2/1962 | Burkhardt | 57/104 |
| 3,131,529 | 5/1964 | Keyser | 57/105 |
| 3,548,582 | 12/1970 | Stanfert | 57/104 X |
| 3,990,222 | 11/1976 | Marzoli | 57/267 |
| 4,090,348 | 5/1978 | DeVittorio | 57/105 |
| 4,313,299 | 2/1982 | Günkinger et al. | 57/267 |
| 4,426,836 | 1/1984 | Briner et al. | 57/67 X |
| 4,612,760 | 9/1986 | Wolf et al. | 57/105 |
| 4,757,679 | 7/1988 | Marzoli | 57/267 |
| 4,781,015 | 11/1988 | Dinkelmann et al. | 57/105 |
| 4,841,789 | 6/1989 | Ochiai | 474/86 X |
| 4,893,460 | 1/1990 | Wolf | 57/100 X |
| 4,944,144 | 7/1990 | Katoh et al. | 57/105 |
| 5,022,223 | 6/1991 | Mena | 57/267 |

FOREIGN PATENT DOCUMENTS

| | | |
|---|---|---|
| 2610785 | 9/1977 | Fed. Rep. of Germany . |
| 3701873 | 8/1987 | Fed. Rep. of Germany . |

*Primary Examiner*—Daniel P. Stodola
*Assistant Examiner*—Michael R. Mansen
*Attorney, Agent, or Firm*—Shefte, Pinckney & Sawyer

[57] ABSTRACT

In a flyer-type textile spinning machine, spinning elements, such as the flyers or the bobbins or both, are driven by plural drive motors affixed at spacings to the rail supporting the spinning elements, each drive motor directly driving synchronously at least one spinning element via a timing belt, with the remaining spinning elements being synchronously driven, in turn, from the directly driven spinning elements via a series of like timing belts.

7 Claims, 2 Drawing Sheets

APPARATUS FOR SYNCHRONOUSLY DRIVING PLURAL SPINNING ELEMENTS IN A TEXTILE SPINNING MACHINE

BACKGROUND OF THE INVENTION

The present invention relates to drive arrangements for the spinning elements of a textile spinning machine, especially drives for the spindles and flyers of a flyer-type spinning machine wherein the spindles and flyers are supported in respective rails extending lengthwise of the machine and are driven in groups by means of toothed or similar timing belt drive arrangements.

Known flyer-type spinning machines of the aforementioned type have a first drive shaft extending the length of the machine positioned beneath the flyer rail for driving the flyers of the machine and a similar lengthwise-extending parallel drive shaft beneath the spindle rail for driving the machine spindles. Each such shaft drives a plurality of intermediate shafts via bevel or mitered gears, the intermediate shafts extending upwardly at regular spacings through the respectively associated spindle or bobbin rail. Toothed pulleys or cogs are fixed to the intermediate shafts extending through the flyer rail for synchronously driving one or more of the flyers via a toothed timing belt or the like. The intermediate shafts which extend through the spindle rail are in the form of splined shafts, each of which drives a toothed pulley or cog supported in the spindle rail, each such pulley or cog in turn driving one or more of the spindles via a timing belt or the like.

The expense of manufacturing this known drive arrangement is considerable as a result of the cost of the constituent shafts, shaft bearings, bevel gears, splined shafts and other components in addition to the cost of assembling such components. Further, this form of drive arrangement consumes a considerable amount of energy and is relatively noisy in operation.

SUMMARY OF THE INVENTION

It is accordingly an object of the present invention to provide a simplified drive arrangement for flyer-type and like textile spinning machines which is correspondingly inexpensive to manufacture and assemble.

Briefly summarized, the drive arrangement of the present invention accomplishes this objective by providing, for either or both the spindle and flyer rails of a textile spinning machine, one or more drive motors (the number depending upon the number of spinning positions) mounted to the rail, with a primary belt drive arrangement operatively connecting each motor with one of the spinning elements associated with the rail (i.e., the spindles or flyers, as the case may be) for driving rotation thereof and a secondary belt drive arrangement operatively connecting the one spinning element and one or more other spinning elements for driving rotation thereof. Each belt drive arrangement is adapted to drive the multiple spinning elements associated with the respective rail synchronously with one another, e.g., through the use of toothed or timing belts or the like.

As will be recognized, such a drive arrangement does not require the provision of drive shafts extending longitudinally along the machine or shaft bearings, deflection gearings, and like components such as conventionally utilized in known spinning machines as described above, so that the design of the present drive arrangement is correspondingly simplified and more economical. Likewise, assembly of the present drive arrangement is equally simple.

According to one feature of the present drive arrangement, the driven spinning elements are constrained to rotate synchrononsly with one another by means of toothed or other timing belts or the like, to assure conformity in the driven speeds of the respective spinning elements which is particularly important for the flyers and spindles of a flyer-type spinning machine. This mechanical synchronization of the spinning elements additionally assures that the elements are maintained in synchronism even in the case of an electrical power outage or other machine stoppage. The synchronization of the spinning elements compelled by such mechanical arrangement can be additionally supported by electrically synchronizing the several drive motors (which preferably are designed as synchronous motors), e.g., by a corresponding frequency control of the motors.

DESCRIPTION OF THE PREFERRED EMBODIMENT

Figure 1:
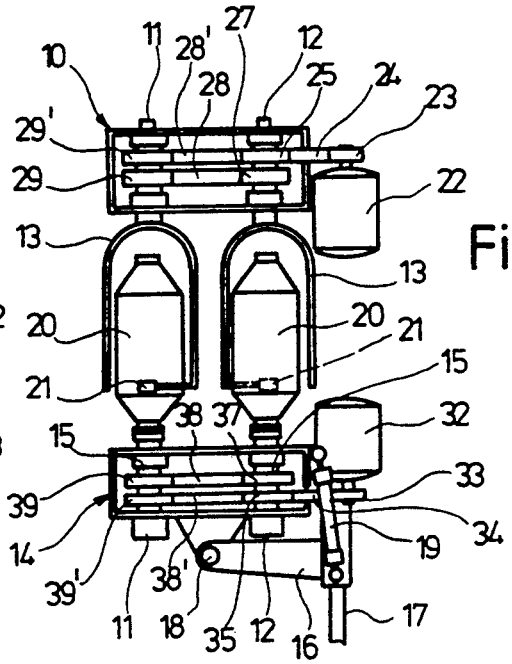
FIG. 1 is an end elevational view of the flyer and spindle rails of a flyer-type spinning machine, i.e., viewed in the longitudinal direction of the machine, showing the drive arrangement of the present invention as preferably embodied therein for driving the machine flyers and spindles.
Figure 3:
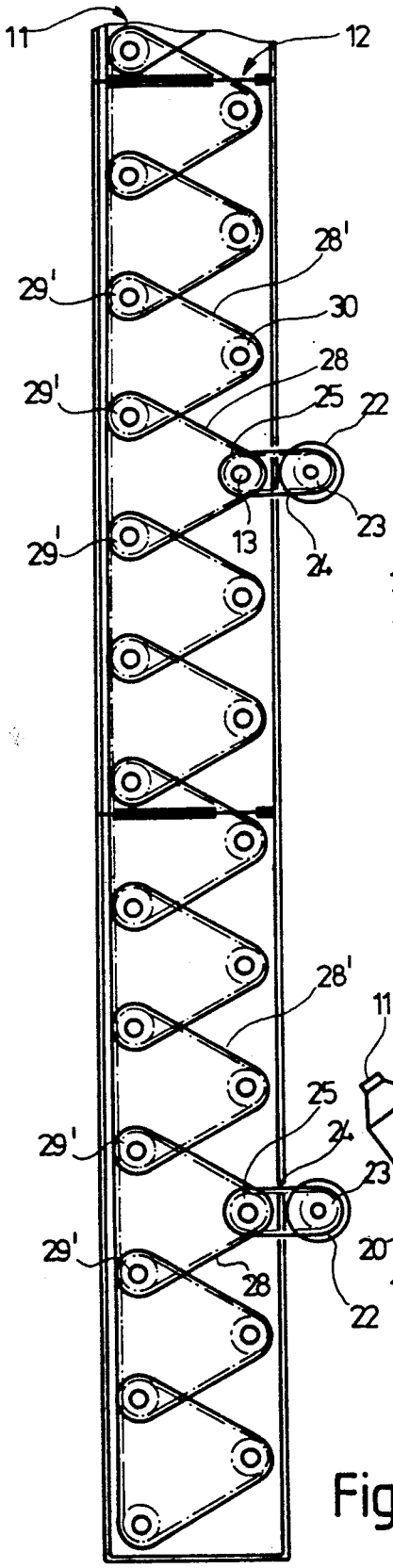
FIG. 3 is a top plan view of the flyer rail and the drive arrangement therefor of the spinning machine of FIG. 1.

Referring now to the accompanying drawings and initially to FIG. 1, the flyer and spindle rail components of a flyer-type spinning machine are shown in end elevation. Basically, the flyer rail 10 rotatably supports in depending fashion two longitudinally-extending rows 11, 12 of plural flyers 13, the respective flyers 13 in each row 11, 12 being longitudinally staggered with respect to one another as shown in FIG. 3. Similarly, the spindle rail 14 rotatably supports two corresponding rows 11, 12 of plural upstanding spindles 15 which are likewise longitudinally staggered with respect to one another.

Figure 2:
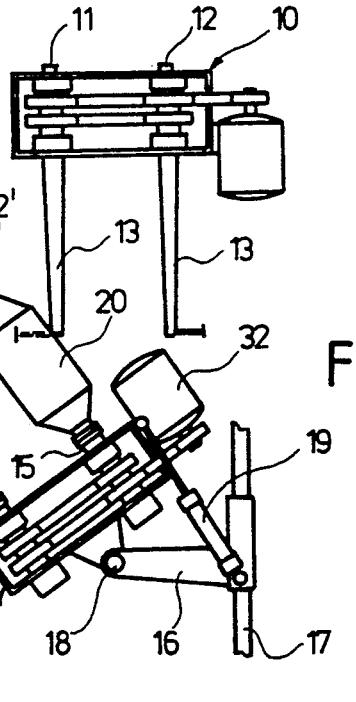
FIG. 2 is a similar end elevational view of the flyer-type spinning machine of FIG. 1, showing the spindle rail pivoted into a doffing position suitable for automatic removal of wound spinning bobbins from the spindles.

The spindle rail 14 is mounted on a plurality of cantilevered arms 16 supported on vertical columns 17 for upward and downward travel therealong by means of a drive (not shown). The spindle rail 14 is pivotably mounted to the support arm 16 via a pivot shaft 18 extending longitudinally along the spinning machine. Several piston-and-cylinder assemblies 19, which may be either hydraulically or pneumatically operated, extend between the spindle rail 14 and the support arms 16 for actuating pivotal movement of the spindle rail 14 between an operating position wherein the spindles 15 are directly aligned coaxially beneath the corresponding flyers 13 of the flyer rail 10, as shown in FIG. 1, and a doffing position wherein the spindle rail 14 is pivoted into an inclined disposition to orient the spindles 15 angularly outwardly to be readily accessible for purposes of automatic doffing of fully-wound yarn bobbins 20 from the spindles 15 in a conventional manner, as shown in FIG. 2.

As will be understood, in the normal spinning operation of the flyer spinning machine, each flyer 13 and spindle 15 form a spinning position which is associated with a respective drafting device (not shown) through which roving is drawn into the form of a yarn which is then directed to travel axially into the head portion of the respective flyer 13 and then through one of the flyer arms to a pressure finger 21 at the end thereof from which the yarn is transferred circumferentially to an associated bobbin 20 supported on the spindle 15.

The plural flyers 13 are driven in groups, each group comprising a sub-plurality of the flyers 13, by a corresponding plurality of electric drive motors 22 each of which is designated for driving a respective group of the flyers 13. Preferably, the drive motors 22 are of substantially identical construction and operation and are each utilized for driving the same number of flyers 13. For such purpose, the drive motors 22 are mounted to the outward lateral side of the flyer rail 10 at regular spacings along the length thereof. More specifically, each drive motor 22 is mounted to the flyer rail 10 directly adjacent one of the flyers 13 of its respective group, which flyer the drive motor 22 directly drives in synchronism with the drive motor shaft via a toothed timing belt 24 which extends in endless fashion about a correspondingly toothed drive pulley or cog 23 affixed to the drive shaft of the motor 22 and a similarly toothed driven pulley or cog 25 affixed coaxially to the flyer 13. As shown by way of example in the embodiment of FIGS. 1–3, every seventh flyer 13 in the row 12 is directly belt driven by the above-described synchronous drive arrangement from a respective drive motor 22.

The remaining flyers 13 of each group of flyers intervening the spaced drive motors 22 are belt-driven, in turn, from the spaced flyers 13 which are directly driven from the drive motors 22. More specifically, as shown in FIGS. 1–3, each directly-driven flyer 13 has another toothed cog or pulley 27 coaxially affixed thereto to also be synchronously driven from the respective drive motor 22, each such pulley 27, in turn, synchronously driving the two most closely adjacent flyers 13 in the opposite flyer row 11 via a toothed timing belt 28 which extends in endless fashion about the pulley 27 and about correspondingly toothed driven pulleys 29 affixed coaxially to the two adjacent flyers 13 to drivingly travel in an equilaterally triangular drive path.

As also shown in FIGS. 1–3, each above-described group of three flyers 13 driven from the drive motors 22, in turn, synchronously drives the remaining flyers 13 in each row 11, 12 intervening the drive motors 22 via a serial arrangement of similar triangular timing belt connections between two adjacent flyers 13 in the row 11 and the interveningly staggered flyer 13 of the other row 12. For this purpose, each flyer 13 in the row 11 has coaxially affixed thereto not only the toothed pulley 29 but also another coaxial correspondingly-toothed pulley 29'. Every flyer 13 in the row 12 other than the flyers 13 driven directly from the drive motors 22 has a correspondingly-toothed drive pulley 30 affixed coaxially thereto. A timing belt 28' extends in endless fashion about the toothed pulleys 29 or 29' and the pulley 30 of each set of two flyers 13 in the row 11 and one flyer 13 in the row 12 to sequentially transmit synchronous driven rotation to all of the flyers 13 intervening the spaced drive motors 22.

Specifically, each flyer 13 in the row 11 located opposite a drive motor 22 and driven thereby via a drive belt 28, in turn, drives the next adjacent pulley 13 in the same row 11 and the next adjacent interveningly staggered flyer 13 in the row 12 via a belt 28, extending triangularly about the pulleys 29' on the flyers 13 of row 11 and the pulley 30 on the flyer 13 in row 12. Each flyer 13 in the row 11 which is so driven, in turn, then drives the next adjacent flyer 13 of the same row 11 and the next adjacent interveningly staggered flyer 13 in the row 12 via another timing belt 28 trained triangularly about the drive pulleys 29 on the flyers 13 in row 11 and the drive pulley 30 on the flyer 13 in row 12, and so on for the remaining flyers 13 intervening the drive motors 22. As will be understood, the drive pulleys 30 on succeeding flyers 13 in the row 12 are offset in height to correspond to the drive pulleys 29 or 29', as the case may be, with which each pulley 30 is drivenly associated.

As will thus be understood, the above-described belt drive arrangement assures that all of the flyers 13 in both flyer rows 11, 12 are mechanically coupled to one another and are thereby mechanically constrained to rotate synchronously with one another. In the illustrated and described embodiment, the electric drive motors 22 which directly drive every seventh flyer 13 of the row 12 are selected to be identical in construction and operation, as aforementioned. To further facilitate synchronous driving of all of the flyers 13, it is considered advantageous to also electrically synchronize the drive motors 22, preferably by means of frequency control.

The bobbin spindles 15 supported in the spindle rail 14 are driven by a corresponding drive arrangement. More particularly, a plurality of identical electric drive motors 32 are affixed to the spindle rail 14 at regular spacings, each drive motor 32 directly driving synchronously one immediately-adjacent bobbin spindle 15 in the spindle row 12 via a toothed timing belt 34 trained in endless fashion about a toothed pulley or cog 33 affixed integrally to the motor drive shaft and a similar toothed pulley or cog 35 affixed integrally to the bobbin spindle 15. In turn, the directly-driven bobbin spindle 15 drives the two most closely adjacent spindles 15 in the other spindle row 11 via another toothed timing belt 38 which extends in endless fashion in an equilaterally triangular drive path about another toothed pulley or cog 37 affixed coaxially to the directly-driven spindle 15 and about respective similarly toothed pulleys or cogs 39 affixed coaxially to the two adjacent spindles 15 of the row 11.

The two spindles 15 in the row 11 thusly driven from the drive motor 22, in turn, synchronously drive the remaining spindles 15 intervening the spaced drive motors 32 via belt-connection of the spindles 15 in serial sets of three in the same manner in which the flyers 13 are driven as described above. More specifically, each of the spindles 15 in the row 11 have rigidly affixed thereto both a toothed drive pulley 39 and another coaxial toothed drive pulley 39' and each of the remaining spindles 15 of row 12 carry a similarly toothed drive pulley (not shown) by which each set of three spindles 15 may be synchronously driven via a timing belt 38' trained about their respective drive pulleys in an equilaterally triangular drive path. In this manner, an integrated uninterrupted belt drive train is produced for mechanically constraining all of the spindles 15 to rotate synchronously under the driving forces generated by the spaced electric drive motors 32.

Since the drive motors 32 are affixed to the spindle rail 14, the described drive arrangement does not hinder or interfere with the aforedescribed pivoting of the spindle rail 14 between its operating disposition of FIG. 1 and its doffing disposition of FIG. 2. In addition to the mechanical synchronization of spindle rotation constrained by the described belt-drive arrangement, it is also preferred that the spindle drive motors 32 be electrically synchronized, as described above with respect to the drive for the flyers 13. In addition, the driven shaft speed of the drive motors 32 is preferably controlled electrically so as to enable the output speed of the motors 32 to be varied in relation to the progressively increasing windings of yarn about the spindle-supported bobbins 20 over the course of the spinning operation.

As those persons skilled in the art will recognize, in the case of many relatively large flyer-type spinning frames having a large number of flyers 13 and spindles 15, it will be necessary as above-described to provide multiple drive motors 22 for the flyers 13 and multiple drive motors 32 for the bobbin spindles 15. However, in the case of relatively smaller flyer spinning machines with a lesser number of flyers 13 and spindles 15, it may be possible to utilize only a single drive motor 22 for the flyers 13 and only a single drive motor 32 for the bobbin spindles 15.

Figure 5:
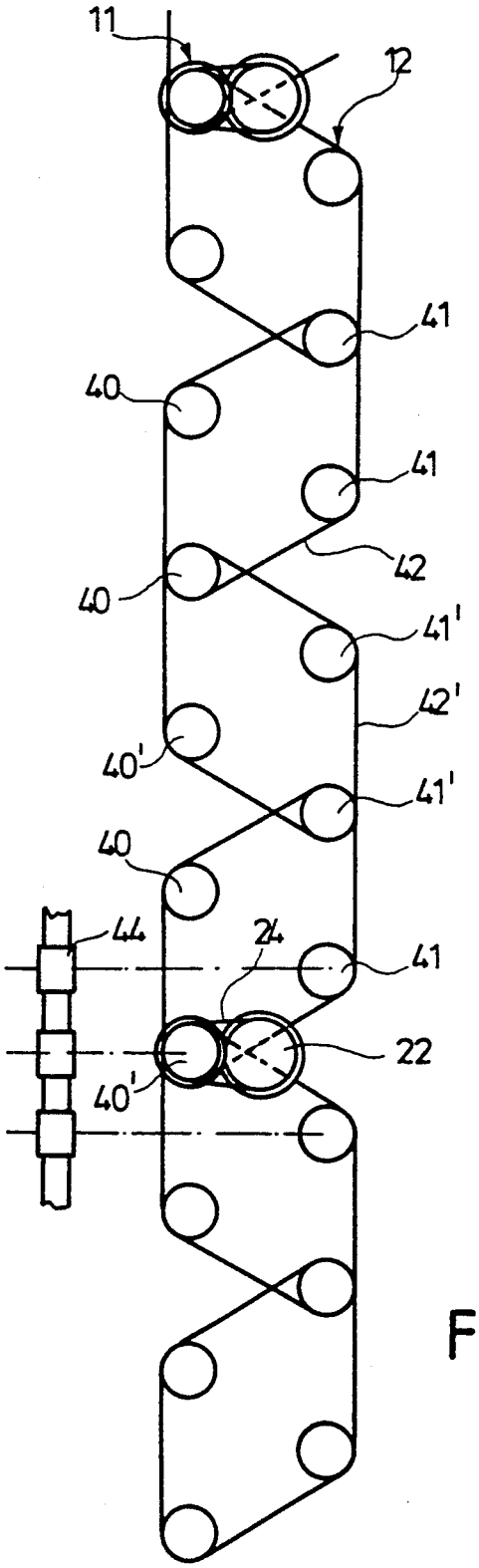
FIG. 5 is a top plan view of the flyer rail and the associated flyer drive arrangement therefor of the spinning machine of FIG. 4.
Figure 4:
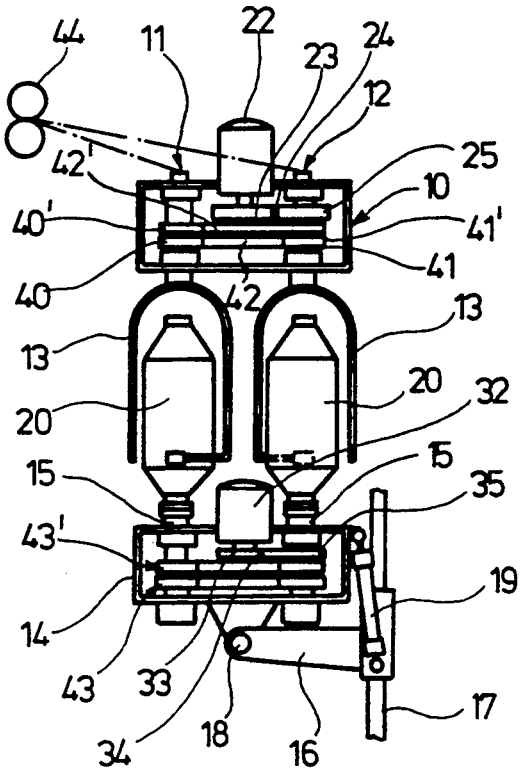
FIG. 4 is an end elevational view of the spindle and flyer rails of another flyer-type spinning machine similar to FIG. 1, showing an alternative embodiment of the drive arrangement of the present invention embodied therein.

FIGS. 4 and 5 illustrate an alternative embodiment of a drive arrangement according to the present invention in a spinning machine which otherwise is substantially the same as illustrated in FIGS. 1-3 and described above. Thus, to the extent the machine components in FIGS. 4 and 5 correspond to the machine components illustrated in the embodiment of FIGS. 1-3, corresponding reference numerals are utilized and the relevant portions of the foregoing description of the construction and operation of such components in FIGS. 1-3 is not repeated. As in the embodiment of FIGS. 1-3, the flyers 13 supported in the flyer rail 10 and the spindles 15 supported in the spindle rail 14 in the spinning machine of FIGS. 4 and 5 are driven in groups via a plurality of electric flyer drive motors 22 and electric spindle drive motors 32 mounted at regular spacings along the length of the flyer and spindle rails 10, 14, respectively. However, in contrast to FIGS. 1-3, the drive motors 22, 32 in this embodiment are not affixed to the outward lateral side of the flyer and spindle rails 10, 14 but instead are centrally mounted as an integral part of the rails 10, 14 for space saving purposes.

As in the embodiment of FIGS. 1-3, each drive motor 22, 32 directly drives a respective immediately-adjacent flyer 13 or spindle 15 synchronously via a timing belt 24, 34 trained in endless fashion about a toothed pulley 23, 33 fixed to the motor shaft and another toothed pulley 25, 35 fixed coaxially to the flyer 13 or spindle 15. As best seen in FIG. 5, this embodiment, in turn, drives the flyers 13 and the spindles 15 from the directly-motor-driven flyers 13 and spindles 15 in successively connected sets of four flyers 13 and spindles 15. Each flyer 13 in the row 11 has two toothed drive pulleys 40, 40' affixed coaxially thereto and, similarly, each flyer 13 in the row 12 has two toothed pulleys 41, 41' affixed coaxially thereto, by which alternate sets of four flyers 13 may be synchronously driven via an endless timing belt 42 trained about their respective pulleys 40, 41 in a rhomboidal path of travel and, likewise, intervening sets of four flyers 13 may also be synchronously driven in corresponding manner via a timing belt 42' trained in endless fashion about their respective pulleys 40', 41' in a similar rhomboidal path of travel. Of course, only those flyers 13 which are engaged by both a belt 42 and a belt 42' (i.e., only every second flyer in row 11 and every second flyer in row 12) must of necessity be provided with two coaxial drive pulleys 40, 40' or 41, 41'. As shown in FIG. 4, each flyer 13 which is directly driven by a drive motor 22 has its drive pulleys 41, 41' supported coaxially with the aforementioned toothed pulley 25 driven by the motor 22. It is contemplated that, in an alternate embodiment, the output drive shaft of each electric drive motor 22 could be directly affixed coaxially to a respective flyer 13 which, for example, could be a flyer 13 engaging only one of the timing belts 42 or 42'.

The bobbin spindles 15 in the embodiment of FIGS. 4 and 5 are driven by an essentially identical drive arrangement to the above-described drive arrangement for the flyers 13. That is, the bobbin spindles 15 intervening the spaced drive motors 32 are mechanically synchronized via a series of timing belts 43, 43, each of which extends in endless fashion in a rhomboid path of travel about four adjacent spindles 15, two in each row 11, 12, for driving synchronous rotation thereof.

FIGS. 4 and 5 also show a representative pair of delivery rollers 44 of one of the drafting devices from which yarn is supplied to the flyers 13. As will be seen in FIG. 5 particularly, the location of the flyer drive motors 22 centrally of the flyer rail 10 in this embodiment permits the incoming yarns from the drafting devices of the spinning machine to be directed to the respective flyers 13 without interference by the motors 22, since the motors 22 are arranged to directly drive flyers 13 in the row 11 which faces the drafting devices. Of course, it will be recognized that it would be equally possible within the principle and scope of the present drive arrangement to directly drive flyers 13 in the row 12 from the drive motors 22, as representatively shown in FIG. 4.

Although the illustrated and described embodiments of FIGS. 1-3 and FIGS. 4 and 5 employ identical drives for their flyers 13 and bobbin spindles 15, it will be recognized by those persons skilled in the art that it is alternatively possible to provide differing drives for the flyers 13 and the spindles 15 within the same spinning machine. For example, the flyers 13 could be driven by a drive arrangement in accordance with the embodiment of FIGS. 1-3 while the bobbin spindles 15 could be driven by a drive arrangement according to FIGS. 4 and 5, or vice versa. Moreover, it would be possible to utilize a drive arrangement in accordance with the present invention only for the flyers 13 or only for the spindles 15. However, the present drive arrangement is particularly preferred for driving the spindles 15.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. In a textile flyer-type spinning machine having a longitudinal rail, a plurality of rotatable spinning elements supported on said rail at spacings longitudinally therealong, and means supporting said rail for vertical movement for normal spinning operation and for pivotal movement about a horizontal axis for doffing said spinning elements, means for synchronously driving said spinning elements comprising a plurality of drive motors affixed at longitudinal spacings to said rail for vertical and pivotal movement unitarily therewith, each said motor having a drive shaft in parallel relation to said spinning elements, primary timing belt drive means operatively connecting each said motor drive shaft and a respective one of said spinning elements for driving rotation thereof, and secondary timing belt drive means operatively connecting all said spinning elements with one another for synchronous driven rotation of said plurality of spinning elements by said plurality of drive motors.

2. Driving means in a textile spinning machine according to claim 1 and characterized further in that said secondary belt drive means includes means for constraining said other spinning element to rotate synchronously with said one spinning element.

3. Driving means in a textile spinning machine according to claim 1 and characterized further in that said secondary belt drive means includes means operatively connecting said other spinning element and a third said spinning element for driving rotation thereof.

4. Driving means in a textile spinning machine according to claim 1 and characterized further in that said secondary belt drive means includes a drive belt trained about three spinning elements in a triangular arrangement with respect to one another.

5. Driving means in a textile spinning machine according to claim 1 and characterized further in that said plurality of spinning elements are arranged in two generally parallel rows with the spinning elements of each said row being staggered with respect to the spinning elements of the other said row, said second belt drive means including a plurality of drive belts, each said drive belt being trained about a respective pair of adjacent spinning elements of one said row and a respective one spinning element of the other said row to extend in a triangular path of travel.

6. Driving means in a textile spinning machine according to claim 5 and characterized further in that each spinning element of said one row has two said drive belts trained thereabout and each spinning element of said other row has only one said drive belt trained thereabout, said one spinning element connected with said drive motor by said primary belt drive means being in said other row.

7. Driving means in a textile spinning machine according to claim 1 and characterized further in that said plurality of spinning elements are arranged in two generally parallel rows with the spinning elements of each said row being staggered with respect to the spinning elements of the other said row, said second belt drive means including a plurality of drive belts, each said drive belt being trained about a respective pair of adjacent spinning elements of one said row and a respective pair of adjacent spinning elements of the other said row.

* * * * *